US007737768B2

(12) United States Patent
Byeon

(10) Patent No.: US 7,737,768 B2
(45) Date of Patent: Jun. 15, 2010

(54) INTERNAL VOLTAGE GENERATOR

(75) Inventor: Sang-Jin Byeon, Kyoungki-do (KR)

(73) Assignee: Hynix Semiconductor, Inc., Gyeonggi-do (KR)

( * ) Notice: Subject to any disclaimer, the term of this patent is extended or adjusted under 35 U.S.C. 154(b) by 134 days.

(21) Appl. No.: 11/717,661

(22) Filed: Mar. 14, 2007

(65) Prior Publication Data

US 2008/0001654 A1 Jan. 3, 2008

(30) Foreign Application Priority Data

Jun. 29, 2006 (KR) ..... 10-2006-0059615

(51) Int. Cl.
*G05F 1/10* (2006.01)
*G05F 3/02* (2006.01)

(52) U.S. Cl. ..... 327/539; 327/538; 327/540; 323/313

(58) Field of Classification Search ..... 327/534–541; 323/313
See application file for complete search history.

(56) References Cited

U.S. PATENT DOCUMENTS 6,278,320 B1 * 8/2001 Vu ..... 327/539
6,316,985 B1 11/2001 Kobayashi et al.
6,486,727 B1 * 11/2002 Kwong ..... 327/534
6,492,862 B2 * 12/2002 Nakahara ..... 327/536
6,809,968 B2 * 10/2004 Marr ..... 280/275
7,009,904 B2 3/2006 Kim
7,248,028 B1 * 7/2007 Voo ..... 323/282
2005/0104566 A1 5/2005 Kim
2005/0105367 A1 5/2005 Kim et al.

FOREIGN PATENT DOCUMENTS

JP 10-199244 A 7/1998
JP 11-26697 A 1/1999
KR 10-2006-0005484 1/2006
KR 10-2007-0080883 8/2007

OTHER PUBLICATIONS

Korean Office Action issued in corresponding Korean Patent Application No. KR 10-2006-0059615, issued on Nov. 30, 2007.

* cited by examiner

*Primary Examiner*—Dinh T. Le
(74) *Attorney, Agent, or Firm*—IP & T Law Firm PLC

(57) ABSTRACT

An internal voltage generator of a semiconductor memory device generates an internal voltage sensitive to a change in a temperature. The internal voltage generator includes a reference voltage generator, an internal voltage detecting unit and an internal voltage pumping unit. The reference voltage generator generates a reference voltage which is inversely proportional to the change in the temperature. The internal voltage detecting unit detects a difference between the reference voltage and the internal voltage to output a pumping control signal according to a detecting result, wherein the pumping control signal has an identical temperature characteristic as the reference voltage. The internal voltage pumping unit generates the internal voltage by a pumping operation in response to the pumping control signal.

26 Claims, 6 Drawing Sheets

INTERNAL VOLTAGE GENERATOR

CROSS-REFERENCE TO RELATED APPLICATIONS

The present invention claims priority of Korean patent application no. 10-2006-0059615, filed in the Korean Patent Office on Jun. 29, 2006, which is incorporated by reference in its entirety.

BACKGROUND OF THE INVENTION

The present invention relates to an internal voltage generator; more particularly, to an internal voltage generator for generating an internal voltage in response to a change in a temperature.

As a semiconductor memory device has been required to operate at a high speed with a low power voltage, and the semiconductor memory device has been manufactured to be highly integrated, an internal voltage generator has been used inside a dynamic random access memory (DRAM). In order to generate an internal voltage, a reference voltage is generated firstly. Then, the internal voltage is generated based on the reference voltage by using a charge pumping method or a down converting method.

A boosted voltage VPP and a back bias voltage VBB are examples of internal voltages generated by the charge pumping method. On the other hand, a core voltage VCORE is often one of the internal voltages generated by the down converting method.

Generally, the boosted voltage VPP, which is higher than an external supply voltage VDD, is supplied to a gate of a cell transistor in order to prevent cell data from being lost. For the same purpose, the back bias voltage VBB, which is lower than an external ground voltage VSS, is supplied to a bulk of the cell transistor. The core voltage VCORE is generated to maintain a constant voltage level even with fluctuations of the external supply voltage VDD. Therefore, power consumption is reduced and core operation becomes stabilized. The core voltage VCORE, which has a lower level than the level of the external supply voltage VDD, is generated by an amplifier for down converting the external supply voltage VDD. In order to generate the internal voltage, detecting the present level of the internal voltage is required before the charge pumping method or the down converting method.

FIG. 1 illustrates a block diagram showing a conventional back bias voltage generator. The back bias voltage generator includes a back bias voltage detecting unit 10 and a back bias voltage pumping unit 20.

The back bias voltage detecting unit 10 receives a back bias voltage VBB, i.e., an output of the back bias voltage pumping unit 20, and outputs a pumping control signal BBEb to control the driving of the back bias voltage pumping unit 20. The back bias voltage pumping unit 20 includes an oscillator, a pump controller, and a pump, for generating the back bias voltage VBB in response to the pumping control signal BBEb.

After the external supply voltage VDD is supplied to the DRAM and reaches a predetermined level for the DRAM to operate, a power up signal is activated. When the power up signal is activated, the DRAM begins to generate an internal voltage by using the charge pumping method. Before this point, the level of the back bias voltage VBB is at the ground voltage level. The back bias voltage detecting unit 10 senses that the back bias voltage VBB is lower than the core voltage VCORE and activates the pumping control signal BBEb. The back bias voltage pumping unit 20 is controlled by the pumping control signal BBEb.

FIG. 2 illustrates a schematic circuit diagram showing the back bias voltage detecting unit 10 depicted in FIG. 1. The back bias voltage detecting unit 10 includes a detector 12, a driver 14 and a level shifter 16.

The detector 12 detects the back bias voltage VBB, which is constant without respect to change in a temperature. The driver 14 drives its output as the core voltage VCORE or the ground voltage VSS in response to an output of the detector 12. The level shifter shifts the level of the output of the driver 14 to the level of the supply voltage VDD or the ground voltage VSS.

The detector 12 includes two PMOS transistors. The first PMOS transistor P1 whose drain and source are respectively coupled to a detecting node DET_NODE and the core voltage VCORE receives the ground voltage VSS through a gate. A bulk of the first PMOS transistor P1 is coupled to the core voltage VCORE. The second PMOS transistor P2 whose drain and source are respectively coupled to the ground voltage VSS and the detecting node DET_NODE receives the back bias voltage VBB through a gate. A bulk of the second PMOS transistor P2 is coupled to the core voltage VCORE.

As the back bias voltage VBB changes, a resistance value of the second PMOS transistor P2 changes. The difference in the resistance values between the first and second transistors P1 and P2 is used to detect the level of the back bias voltage VBB. For example, when the back bias voltage VBB decreases, the resistance value of the second PMOS transistor P2 increases. A voltage level of the detecting node DET_NODE becomes higher than the level of a threshold voltage, i.e., a switching point of the driver 14. Generally, the threshold voltage is a half level of the core voltage VCORE. Therefore, a lower transistor of the driver 14 is turned on and the ground voltage VSS is outputted to a driving node D_NODE.

When the ground voltage VSS is output to the driving node D_NODE, there is no level shifting operation in the level shifter 16. The pumping control signal BBEb is activated in a low logic level and drives the back bias voltage pumping unit 20.

Otherwise, when the back bias voltage VBB increases, the resistance value of the second PMOS transistor P2 decreases. The voltage level of the detecting node DET_NODE becomes lower than the level of the threshold voltage. The core voltage VCORE is output to the driving node D_NODE. When the core voltage VCORE is output to the driving node D_NODE, the level shifter 16 shifts the voltage level of the driving node D_NODE to the level of the supply voltage VDD. The pumping control signal BBEb activated in a high logic level does not drive the back bias voltage pumping unit 20. The back bias voltage VBB is maintained as a constant voltage level according to the operation of the back bias voltage pumping unit 20.

However, the conventional back bias voltage detecting unit 10 is not able to precisely detect the back bias voltage VBB in response to changes in a temperature. Though the back bias voltage VBB changes due to temperature changes, the back bias voltage detecting unit 10 will detect a constant voltage level.

Because voltages Vbs, Vgs and Vds required to operate the first and second PMOS transistors P1 and P2 hardly change within an operation range of the transistors and the first and second PMOS transistors P1 and P2 have similar resistance characteristics for change in the temperature, the back bias voltage detecting unit 10 will detect a constant voltage level without respect to changes in the temperature. Herein, the voltages Vbs, Vgs and Vds are voltages loaded between source and bulk, between gate and source and between drain and source of a transistor, respectively.

SUMMARY OF THE INVENTION

Embodiments of the present invention are directed to provide an internal voltage generator of a semiconductor memory device for generating an internal voltage which is responsive to changes in a temperature.

In accordance with an aspect of the present invention, a internal voltage generator of a semiconductor memory device comprises a reference voltage generator for generating a reference voltage, which is inversely proportional to a change in a temperature, and an internal voltage detecting unit for detecting a difference between the reference voltage and an internal voltage to output a pumping control signal according to a detecting result, wherein the pumping control signal has an identical temperature characteristic as the reference voltage.

In accordance with an another aspect of the present invention, an internal voltage generator of a semiconductor memory device comprises a reference voltage generator for generating a reference voltage, which is inversely proportional to a change in a temperature, an internal voltage detecting unit for detecting a difference between the reference voltage and an internal voltage to output a pumping control signal according to a detecting result, wherein the pumping control signal has an identical temperature characteristic as the reference voltage, and an internal voltage pumping unit for generating the internal voltage by a pumping operation in response to the pumping control signal.

DESCRIPTION OF SPECIFIC EMBODIMENTS

In accordance with the present invention, an internal voltage is compared to a reference voltage which is sensitive to a temperature. Accordingly the internal voltage also becomes sensitive to the temperature.

In particular, where an absolute value of a back bias voltage VBB increases as the temperature decreases, a margin for a write recovery time tWR of a memory cell can be maintained. Malfunction caused by a change in a temperature is prevented. Likewise, because the absolute value of the back bias voltage VBB decreases in a high temperature condition, a leakage current is reduced, which prevents a period of a refresh operation from being shortened.

As the margin for a write recovery time tWR is secured, the yield on input and output of data is improved. Testing ability is also improved and the cost and time for testing can be reduced. In addition, since a detector of an internal voltage generator according to an embodiment of the present invention includes a comparator, a response characteristic of the detector is improved.

Hereinafter, a semiconductor memory device in accordance with the present invention will be described in detail referring to the accompanying drawings.

Figure 1:
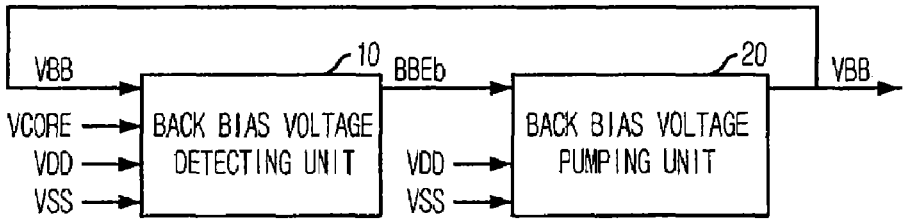
FIG. 1 (RELATED ART)
FIG. 1 is a block diagram showing a conventional back bias voltage generator.
Figure 2:
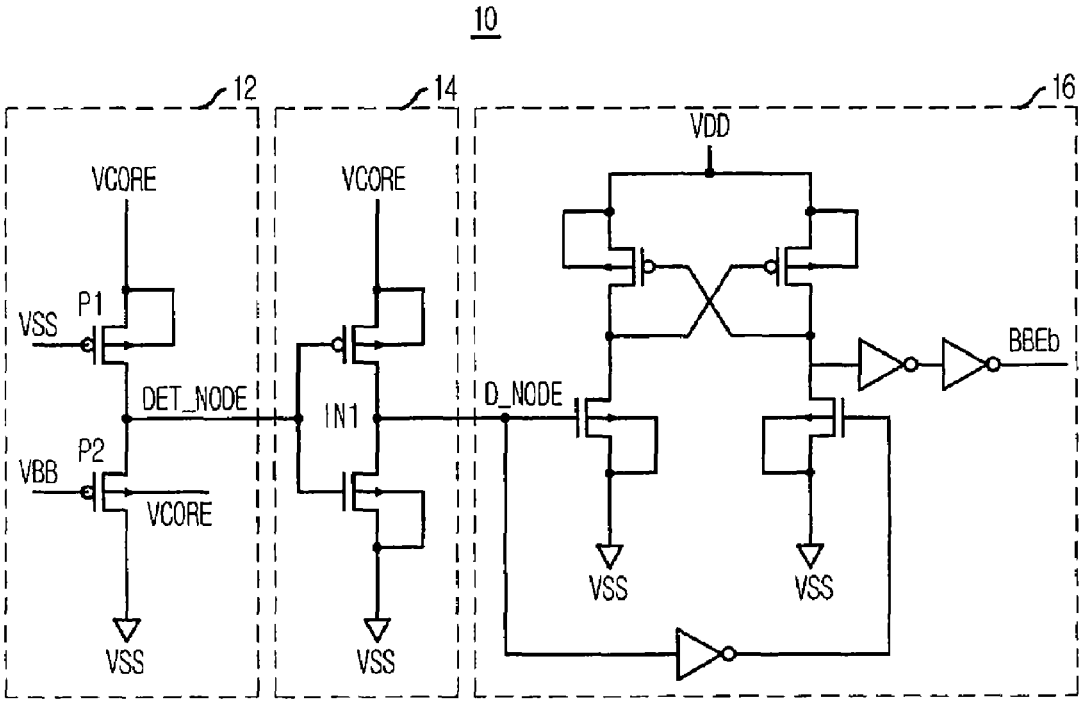
FIG. 2 (RELATED ART)
FIG. 2 is a schematic circuit diagram showing a back bias voltage detecting unit depicted in FIG. 1.
Figure 3:
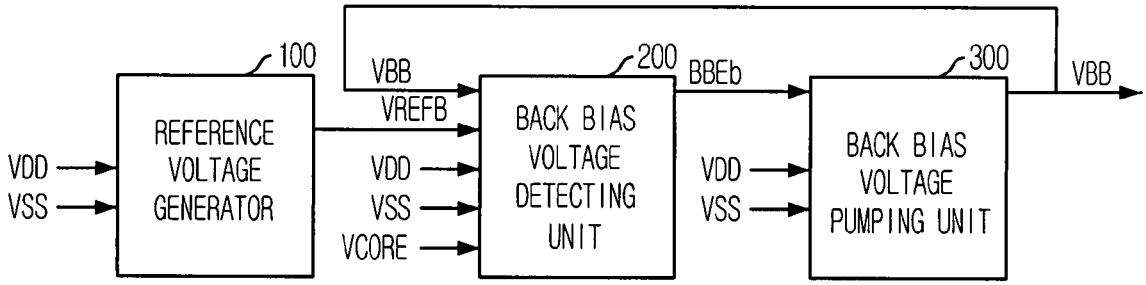
FIG. 3 is a block diagram showing a back bias voltage generator in accordance with the present invention.

FIG. 3 illustrates a block diagram showing a back bias voltage generator in accordance with the present invention. The back bias voltage generator includes a reference voltage generator 100, a back bias voltage detecting unit 200 and a back bias voltage pumping unit 300.

The reference voltage generator 100 as a band gap circuit is hardly influenced by changes of process and voltage. However, the reference voltage generator 100 outputs a reference voltage VREFB which decreases as a temperature increase. The back bias voltage detecting unit 200 receives the reference voltage VREFB output from the reference voltage generator 100, and the back bias voltage VBB output from the back bias voltage pumping unit 300. The back bias voltage detecting unit 200 outputs a pumping control signal BBEb. The back bias voltage pumping unit 300 includes an oscillator, a pump controller and a pump. The back bias voltage pumping unit 300 generates the back bias voltage VBB in response to the pumping control signal BBEb.

Figure 4:
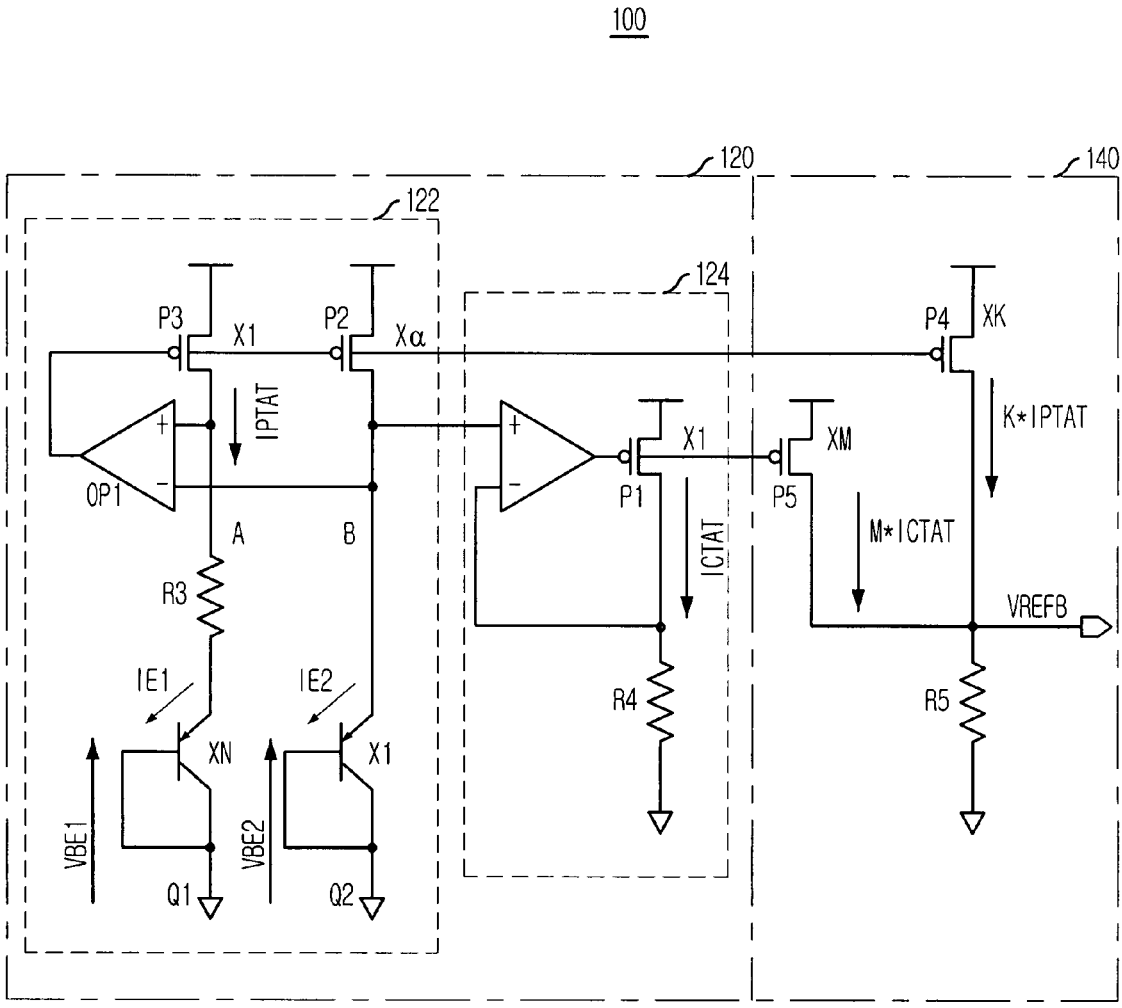
FIG. 4 is a schematic circuit diagram showing a reference voltage generator depicted in FIG. 3.

FIG. 4 illustrates a schematic circuit diagram showing the reference voltage generator 100 depicted in FIG. 3. The reference voltage generator 100 generates the reference voltage VREFB, which is inversely proportional to a change in a temperature. That is, the level of the reference voltage VREFB changes in the reverse direction in response to a change in the temperature.

The reference voltage generator 100 includes a current generator 120 and a voltage level setting unit 140. The current generator 120 generates first and second currents IPTAT and ICTAT. The level of the first current IPTAT is proportional to the change in the temperature and the level of the second current ICTAT is inversely proportional to the change in the temperature. The voltage level setting unit 140 determines the level of the reference voltage VREFB in proportion to the level of a third current. The third current is generated by adding the first and second currents IPTAT and ICTAT in the predetermined proportion of K to M. Accordingly, the level of the reference voltage VREFB is inversely proportional to the change in the temperature.

The current generator 120 includes a first current generator 122 and a second current generator 124. The first current generator 122 supplies the first base-emitter voltage VBE1, which is proportional to a first emitter current IE1 of a first bipolar transistor Q1, to a resistor R3, generating the first current IPTAT. The second current generator 124 cascaded with the first current generator 122 supplies the second base-emitter voltage VBE2, which is proportional to a second emitter current IE2 of a second bipolar transistor Q2, to a resistor R4, generating the second current ICTAT. The first emitter current IE1 is N times higher than the second emitter current IE2, where N is positive integer.

The voltage level setting unit 140 supplies the third current to resistor R5 and generates the reference voltage VREFB. The third current is generated by a adding a current K*IPTAT which is K times higher than the first current IPTAT and a current M*ICTAT which is M times higher than the second current ICTAT.

In accordance with an exemplary embodiment of the present invention, a method for generating the reference voltage VREFB is described below. The reference voltage generator 100 uses vertical PNP bipolar junction transistors (BJT) Q1 and Q2, which are insensitive to the variations in the manufacturing process. Due to a temperature characteristic of the BJT, the reference voltage generator 100 generates the currents IPTAT and M*IPTAT Proportional To Absolute Temperature (PTAT) and the currents ICTAT and K*ICTAT Complementary proportional To Absolute Temperature (CTAT). Through combination of the currents, the reference voltage generator 100 generates the reference voltage VREFB, which is not influenced by the variations in the manufacturing process and voltage but is sensitive to the change in the temperature.

A common equation regarding the current and voltage of a diode is described by the following equation 1.

$$I_Q = I_S\left(\exp\left[\frac{V_{BE}}{V_T}\right] - 1\right) \approx I_S \exp\left[\frac{V_{BE}}{V_T}\right]_{V_{BE?}V_T} \quad \text{[EQUATION 1]}$$

An equation regarding the current and voltage of the two BJTs Q1 and Q2 in the proportion of N to 1 is described by the following equation 2 and 3.

$$I_{Q1} = NI_S \exp\left[\frac{V_{BE1}}{V_T}\right] \quad \text{[EQUATION 2]}$$

$$I_{Q2} = I_S \exp\left[\frac{V_{BE2}}{V_T}\right] \quad \text{[EQUATION 3]}$$

Herein, currents $I_{Q1}$ and $I_{Q2}$ are base-emitter currents passing through each BJT Q1 and Q2. Because node A and node B are virtually shorted by an operational amplifier OP1, the voltage level of the nodes A and B is identical. The first current IPTAT passing through the resistor R3 is described by the following equation 4.

$$I_{PATAT} = \frac{(V_{BE2} - V_{BE1})}{R_3} = \frac{\ln(N\alpha)V_T}{R_3} \quad \text{[EQUATION 4]}$$

Likewise, the second current ICTAT passing through the resistor R4 is described by the following equation 5.

$$I_{CTAT} = \frac{V_{BE2}}{R_4} \quad \text{[EQUATION 5]}$$

On the assumption that the amount of current for PMOS transistors having identical characteristics is identical, a current passing through a fifth PMOS transistor P5 is proportional to a current passing through a first PMOS transistor P1. Accordingly, the current passing through the fifth PMOS transistor P5 is described by the following equation 6.

$$I_5 = MI_{PTAT} \quad \text{[EQUATION 6]}$$

Likewise, a current passing through a fourth PMOS transistor P4 is proportional to a current passing through a third transistor P3 as expressed in the following equation 7.

$$I_4 = KI_{CTAT} \quad \text{[EQUATION 7]}$$

With the currents M*IPTAT and K*ICTAT passing through the fourth and fifth transistors P4 and P5, the reference voltage VREFB is calculated as follows.

$$V_{REFB} = \frac{KR_5}{R_4\left(V_{BE} + \left(\frac{MR_4}{KR_3}\right)\ln(N\alpha)V_T\right)} \quad \text{[EQUATION 8]}$$

Appropriately controlling the proportions N, K and M and the values of resistors R3, R4 and R6, the reference voltage VREFB has a constant voltage level against the change of process and voltage. Generally, in the situation of fixed values N, R3, R4 and R5, the output is controlled by setting the values K and M.

Figure 5:
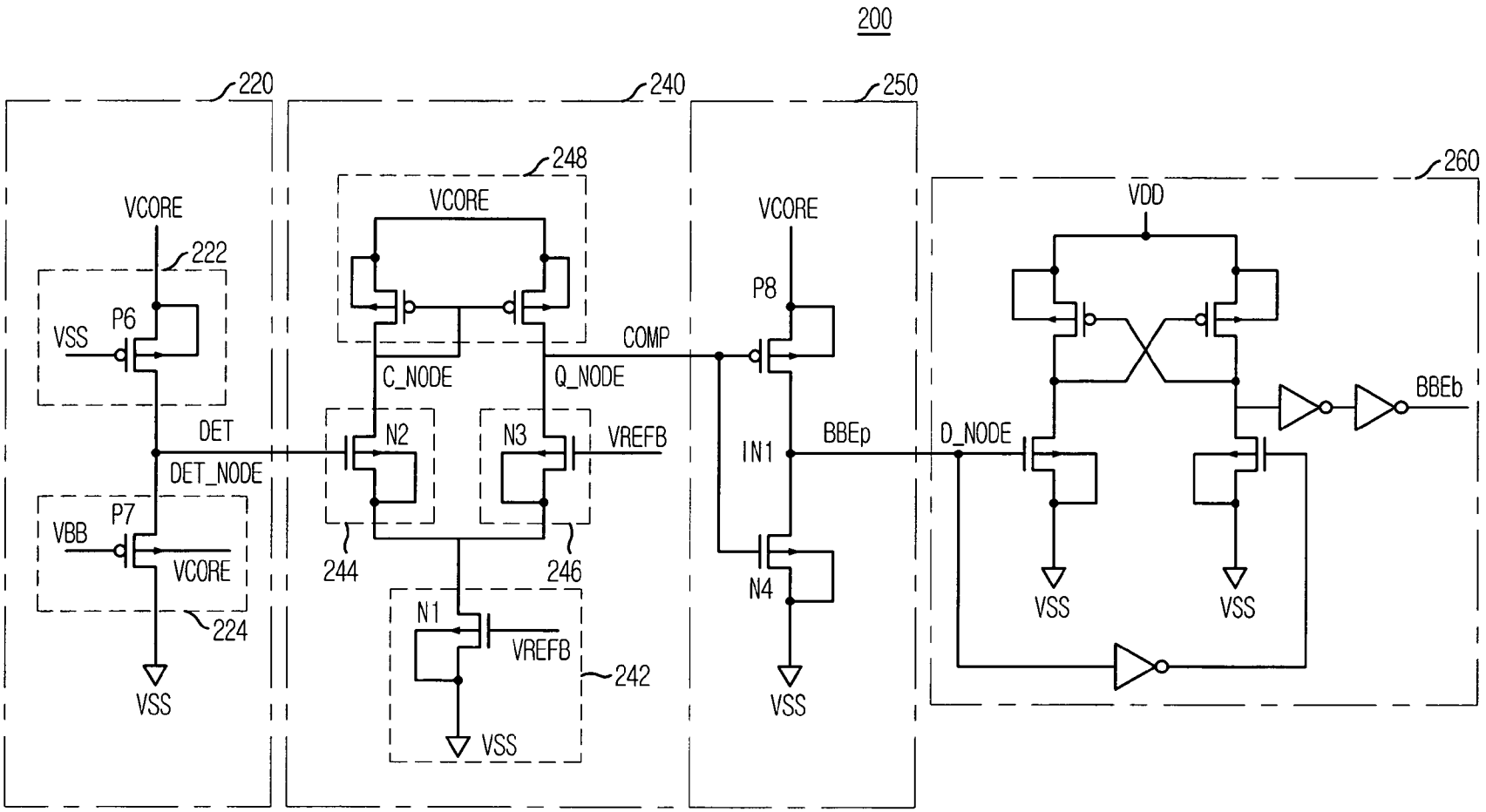
FIG. 5 is a schematic circuit diagram showing a back bias voltage detecting unit depicted in FIG. 3.

FIG. 5 illustrates a schematic circuit diagram showing the back bias voltage detecting unit 200 depicted in FIG. 3. The back bias voltage detecting unit receives the back bias voltage VBB and detects the level of the back bias voltage VBB. According to a detecting result, the back bias voltage drives a pumping control signal BBEb. The pumping control signal BBEb has an identical temperature characteristic as the reference voltage VREFB.

The back bias voltage detecting unit 200 includes a voltage level detector 220, a comparator 240 and a driver 250. The voltage level detector 220 receives the back bias voltage VBB and outputs a detecting voltage DET which is insensitive to changes in a temperature. Comparing the detecting voltage DET and the reference voltage VREFB, the comparator 240 generates a comparing voltage COMp which has an identical temperature characteristic with the reference voltage VREFB. The driver 250 outputs a pre pumping control signal BBEp in response to the comparing voltage COMp.

The back bias voltage detecting unit 200 further includes a voltage level shifter 260. The voltage level shifter 260 shifts the level of the pre pumping control signal BBEp to the level of the supply voltage VDD or the ground voltage VSS to output the pumping control signal BBEb.

The voltage level detector 220 includes first and second resistive elements 222 and 224 in series between the core voltage VCORE and the ground voltage VSS. According to a resistance difference between the first and second resistant elements 222 and 224, the detecting voltage DET is output at a detecting node DET_NODE where the first and second resistant elements 222 and 224 are coupled.

The first resistive element 222 includes a sixth PMOS transistor P6 whose drain and source are respectively coupled to the core voltage VCORE and the detecting node DET_NODE. The resistance of the sixth PMOS transistor P6 receiving the ground voltage VSS through a gate changes according to the level of the ground voltage VSS. The second resistive element 224 includes a seventh PMOS transistor P7 whose drain and source are respectively coupled to the detecting node DET_NODE and the ground voltage VSS. The resistance of the seventh PMOS transistor P7 receiving the back bias voltage VBB through a gate changes according to the level of the back bias voltage VBB.

The comparator 240 includes an enabling controller 242, third and fourth resistive elements 244 and 246, and a mirror circuit 248. The enabling controller 242 enables or disables the comparator 240 in response to the reference voltage VREFB. The third resistive element 244 drops the detecting voltage DET due to its resistance and outputs a dropped detecting voltage to a control node C_NODE. The fourth resistant element 246 drops the reference voltage VREFB due to its resistance and outputs a dropped reference voltage to an output node Q_NODE. The mirror circuit 248 controls the level of the comparing voltage COMp loaded on the output node Q_NODE in response to a voltage loaded on the control node C_NODE.

When the detecting voltage DET decreases, the voltage loaded on the control node C_NODE increases. Consequently the comparing voltage COMp decreases. Otherwise, when the detecting voltage DET increases, the voltage loaded on the control node C_NODE decreases. Consequently the comparing voltage COMp increases.

As a current source of the comparator 240, the enabling controller 242 includes a first NMOS transistor N1 for controlling connection with the ground voltage VSS in response to the reference voltage VREFB. The third resistive element 242 includes a second NMOS transistor N2 for connecting the control node C_NODE with the current source in response to the detecting voltage DET. The fourth resistive element 246 includes a third NMOS transistor N3 for connecting the output node Q_NODE with the current source in response to the reference voltage VREFB.

The driver 250 drives one of the core voltage VCORE and the ground voltage VSS to a driving node D_NODE in response to the comparing voltage COMp. The driver 250 includes PMOS and NMOS transistors P8 and N4. The eighth PMOS transistor P8, whose drain and source are respectively coupled to the driving node D_NODE and the core voltage VCORE, receives the comparing voltage COMp through a gate. The eighth PMOS transistor P8 connects the driving node D_NODE with the core voltage VCORE in response to the level of the comparing voltage COMp. The fourth NMOS transistor N4, whose drain and source are respectively coupled to the driving node D_NODE and the ground voltage VSS, receives the comparing voltage COMp through a gate. The fourth NMOS transistor N4 connects the driving node D_NODE with the ground voltage VSS in response to the level of the comparing voltage COMp.

Figure 6:
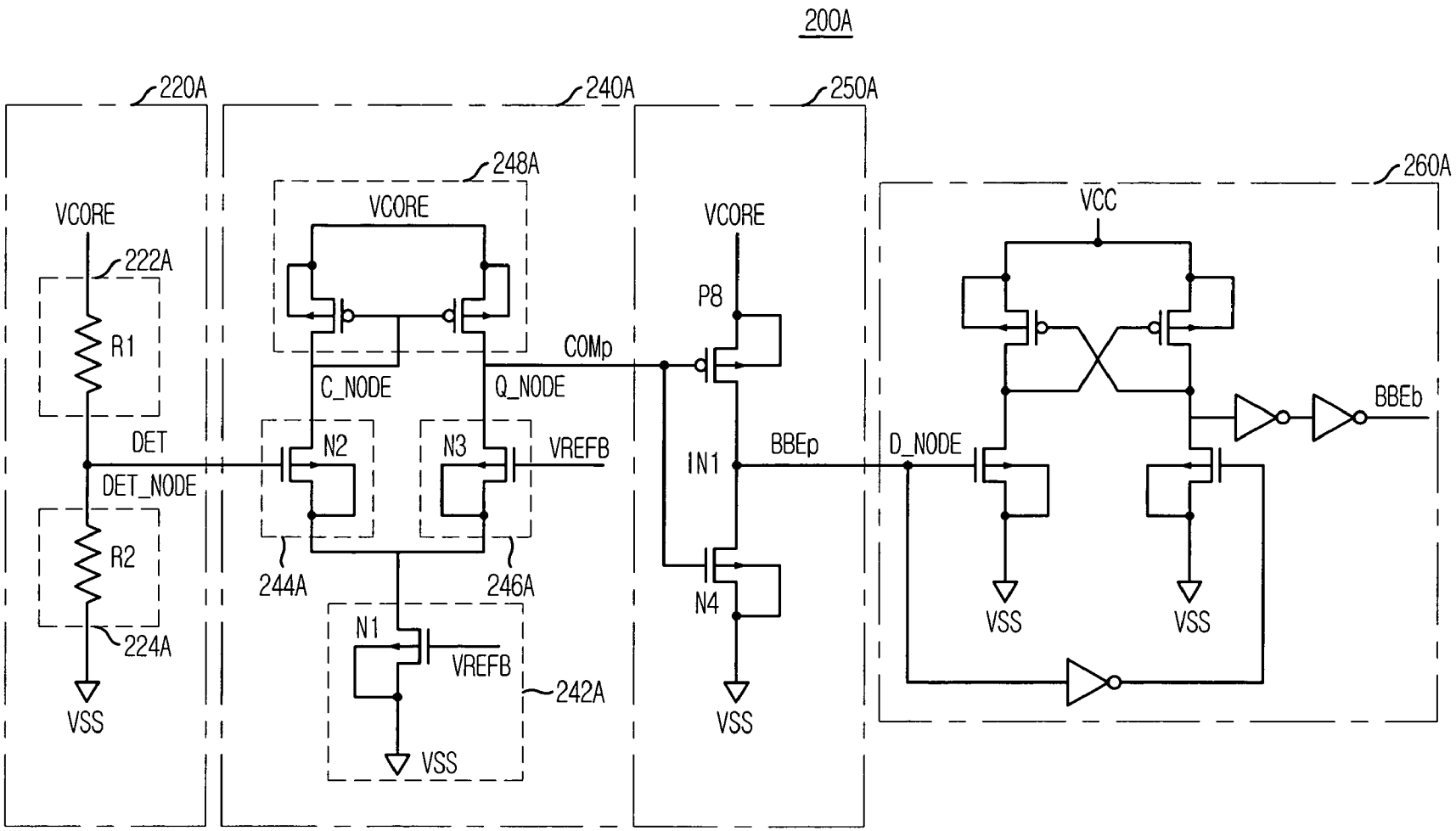
FIG. 6 is a schematic circuit diagram showing the back bias voltage detecting unit in accordance with another embodiment of the present invention.

FIG. 6 illustrates a schematic circuit diagram showing the back bias voltage detecting unit 200A in accordance with another embodiment of the present invention. Compared with the embodiment depicted in FIG. 5, a comparator 240A, a driver 250A and a voltage level shifter 260A have substantially identical structures. The voltage level detector 220A is embodied differently. While the voltage level detector 220 described in FIG. 5 includes the first and second resistive elements 222 and 224 having variable resistance, the voltage level detector 220A in another embodiment of the present invention includes first and second resistive elements 222A and 224A having constant resistance.

The first resistive element 222A includes a first resistor R1 connected between the core voltage VCORE and a detecting node DET_NODE. The second resistive element 224A includes a second resistor R2 connected between the detecting node DET_NODE and the ground voltage VSS. As compared to the back bias voltage VBB detected by the back bias voltage detecting unit 200, the back bias voltage VBB detected by the back bias voltage detecting unit 200A is less influenced by the variations in the manufacturing process and voltage.

Figure 7:
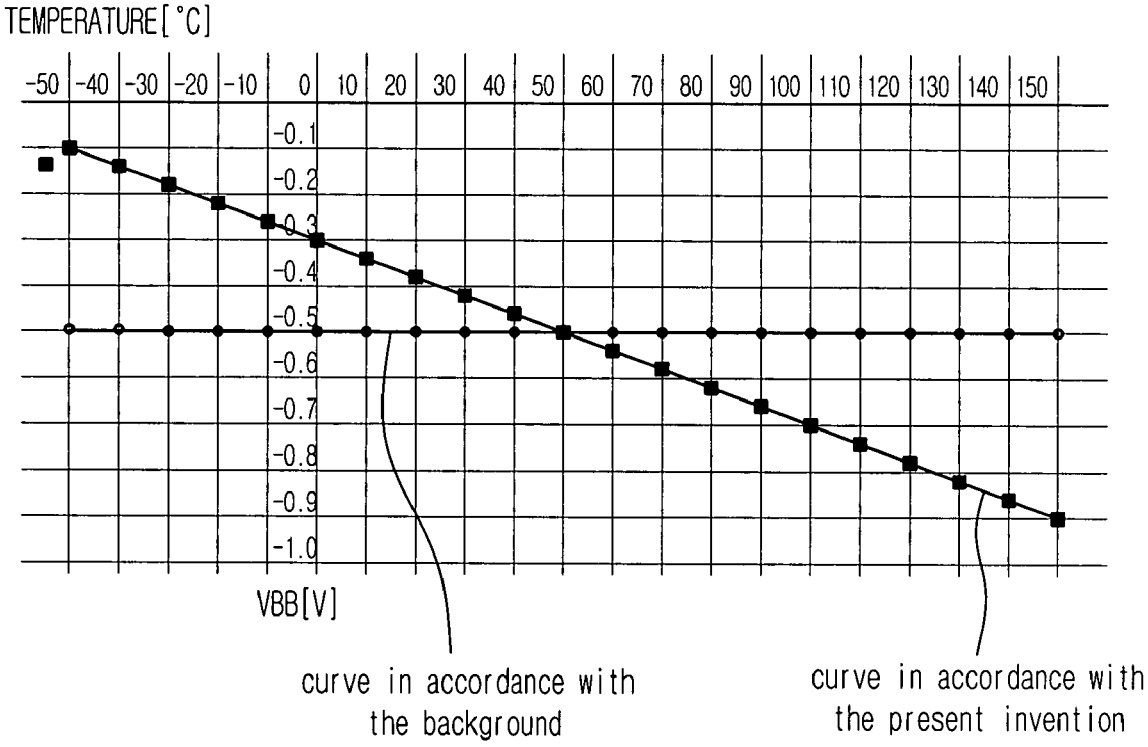
FIG. 7 is a diagram illustrating a change of a back bias voltage according to a temperature.

FIG. 7 is a diagram illustrating the change of the back bias voltage according to the temperature. In a conventional back bias voltage generator, the level of the back bias voltage VBB is constant according to changes in the temperature. However, the level of the back bias voltage VBB decreases as the temperature increases in the present invention. That is, the level of the back bias voltage changes as the temperature changes.

Among internal voltages used in the semiconductor memory device, only an embodiment of the back bias voltage VBB is discussed above. However, the present invention can be applied to all kinds of internal voltage generators for generating internal voltages, particularly for internal voltages for which a level compensation is required according to the change in the temperature.

In accordance with the present invention, a well-bias voltage of a core NMOS transistor in a sense amplifier can also be inversely proportional to a change in a temperature. Accordingly, an absolute value of the well-bias voltage decreases as the temperature increases. A core NMOS transistor which is able to compensate influences by its threshold voltage proportional to the temperature can be embodied.

Otherwise, a boosted voltage VPP used as a well-bias voltage of a core PMOS transistor in a sense amplifier can be proportional to the change in the temperature. Accordingly, an absolute value of the boosted voltage VPP increases as the temperature increases. A core NMOS transistor can compensate influences by its threshold voltage inverse proportional to the temperature.

In the semiconductor memory device for operating at zero-temperature coefficient (ZTC) under a low power voltage, a threshold voltage of a PMOS transistor changes much more than a threshold voltage of a NMOS transistor according to changes in the temperature. A fluctuation of the threshold voltage due to a temperature change in the PMOS transistor can be set to be similar to that in the NMOS transistor by decreasing a ZTC of the PMOS transistor in the present invention. That is, a timing mismatch according to the change in the temperature is prevented. The present invention can support not only changing an internal voltage, but also a period of a self refresh operation, according to the change in the temperature.

While the present invention has been described with respect to the particular embodiments, it will be apparent to those skilled in the art that various changes and modifications may be made without departing from the spirit and scope of the invention as defined in the following claims.

What is claimed is:

1. An internal voltage generator for generating an internal voltage of a semiconductor memory device, comprising:

a reference voltage generator for generating a reference voltage which increases or decreases in inverse proportion to a change in a temperature; and an internal voltage detecting unit for detecting a difference between the reference voltage and the internal voltage to output a pumping control signal according to a detecting result;

wherein the reference voltage generator includes:

a current generator for generating a first current proportional to the change in the temperature and a second current inversely proportional to the change in the temperature; and a voltage level setting unit for determining the level of the reference voltage in proportion to the level of a third current generated by adding the first and second currents in a predetermined proportion, wherein the reference voltage is inversely proportional to the change in the temperature.

2. The internal voltage generator of claim 1, wherein the internal voltage detecting unit includes:

a voltage level detector for receiving the internal voltage and outputting a detecting voltage which is insensitive to the change in the temperature;

a comparator for comparing the detecting voltage and the reference voltage and generating a comparing voltage which is inversely proportional to a change in a temperature; and a driver for outputting a pre pumping control signal in response to the comparing voltage.

3. The internal voltage generator of claim 2, wherein the internal voltage detecting unit further includes a voltage level shifter for shifting the level of the pre pumping control signal to a predetermined voltage level.

4. The internal voltage generator of claim 2, wherein the voltage level detector includes first and second resistive elements in series between a core voltage and a ground voltage and outputs the detecting voltage at a common node of the first and second resistive elements according to the difference of resistance values between the first and second resistant elements.

5. The internal voltage generator of claim 4, wherein the first resistive element has the resistance value changed in response to the ground voltage; and the second resistive element has the resistance value changed in response to the internal voltage.

6. The internal voltage generator of claim 5, wherein the first resistive element includes a first PMOS transistor for connecting the core voltage and the common node in response to the ground voltage received through a gate wherein the core voltage and the common node are respectively coupled to drain and source of the first PMOS transistor.

7. The internal voltage generator of claim 5, wherein the second resistive element includes a second PMOS transistor for connecting the common node and the ground voltage in response to the internal voltage received through a gate wherein the common node and the ground voltage are respectively coupled to drain and source of the second PMOS transistor.

8. The internal voltage generator of claim 4, wherein the voltage level detector includes first and second resistive elements having constant resistance.

9. The internal voltage generator of claim 8, wherein the first resistive element includes a first resistor connected between the core voltage and the common node for having predetermined resistance.

10. The internal voltage generator of claim 8, wherein the second resistive element includes a second resistor connected between the common node and the ground voltage for having predetermined resistance.

11. The internal voltage generator of claim 2, wherein the comparator includes:

an enabling controller for enabling or disabling the comparator in response to the reference voltage;

a first resistive element for dropping the detecting voltage due to the resistance of a third resistive element and outputting a dropped detecting voltage to a control node;

a second resistive element for dropping the reference voltage due to the resistance of a fourth resistive element and outputting a dropped reference voltage to an output node; and a mirror circuit for controlling the level of the comparing voltage loaded on the output node in response to a voltage loaded on the control node.

12. The internal voltage generator of claim 11, wherein the comparator decreases the comparing voltage on the output node as the voltage on the control node increases by a descent of the detecting voltage.

13. The internal voltage generator of claim 11, wherein the comparator increases the comparing voltage loaded on the output node as the voltage loaded on the control node decreases by an ascent of the detecting voltage.

14. The internal voltage generator of claim 11, wherein the enabling controller, as a current source of the comparator, includes a first NMOS transistor for connecting the comparator with the ground voltage in response to the reference voltage.

15. The internal voltage generator of claim 11, wherein the third resistive element includes a second NMOS transistor for connecting the control node with the current source in response to the detecting voltage received though a gate wherein the control node and the current source are respectively coupled to a drain and a source.

16. The internal voltage generator of claim 11, wherein the fourth resistive element includes a third NMOS transistor for connecting the output node with the current source in response to the reference voltage received through a gate wherein the output node and the current source are respectively coupled to a drain and a source.

17. The internal voltage generator of claim 2, wherein the driver drives one of a core voltage and a ground voltage to a driving node in response to the comparing voltage.

18. The internal voltage generator of claim 17, wherein the driver includes a third PMOS transistor for connecting the core voltage with the driving node in response to the comparing voltage received though a gate wherein the core voltage and the driving node are respectively coupled to a drain and a source.

19. The internal voltage generator of claim 17, wherein the driver includes a fourth NMOS transistor for connecting the driving node with the ground voltage in response to the comparing voltage received though a gate wherein the driving node and the ground voltage are respectively coupled to a drain and a source.

20. The internal voltage generator of claim 1, wherein the current generator includes:

a first current generator for supplying a first base-emitter voltage, which is proportional to a first emitter current of a first bipolar transistor, to a third resistor and generating the first current; and a second current generator cascaded with the first current generator for supplying a second base-emitter voltage, which is proportional to a second emitter current of a second bipolar transistor, to a fourth resistor and generating the second current, wherein the first emitter current is at a predetermined ratio higher than the second emitter current.

21. The internal voltage generator of claim 1, wherein the voltage level setting unit supplies the third current, which is generated by a adding a current which is K times higher than the first current and a current which is M times higher than the second current, to a fifth resistor and generates the reference voltage.

22. The internal voltage generator of claim 1, wherein the internal voltage includes a back bias voltage used in the semiconductor memory device.

23. An internal voltage generator of a semiconductor memory device, comprising:

a current generator configured to generate a first current proportional to a change in a temperature and a second current inversely proportional to the change in the temperature;

a voltage level setting unit configured to determine a level of a reference voltage in proportion to a level of a third current generated by adding the first and second currents in a predetermined proportion; and an internal voltage detecting unit configured to detect a difference between the reference voltage and an internal voltage to output a pumping control signal according to a detecting result.

24. The internal voltage generator of claim 23, wherein the reference voltage is inversely proportional to the change in the temperature.

25. The internal voltage generator of claim 24, wherein the internal voltage detecting unit includes:

a voltage level detector configured to receive the internal voltage and output a detecting voltage which is insensitive to the change in the temperature;

a comparator configured to compare the detecting voltage and the reference voltage and generate a comparing voltage which is inversely proportional to a change in the temperature;

a driver configured to output a pre pumping control signal in response to the comparing voltage; and a voltage level shifter configured to shift the level of the pre pumping control signal to a predetermined voltage level.

26. The internal voltage generator of claim 23, further comprising an internal voltage pumping unit configured to generate the internal voltage by a pumping operation in response to the pumping control signal.

* * * * *